US007059286B2

(12) United States Patent
Kusano et al.

(10) Patent No.: US 7,059,286 B2
(45) Date of Patent: Jun. 13, 2006

(54) VALVE TIMING CONTROL APPARATUS FOR INTERNAL COMBUSTION ENGINE

(75) Inventors: Shigeyuki Kusano, Okazaki (JP); Yasushi Morii, Nagoya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/986,280

(22) Filed: Nov. 12, 2004

(65) Prior Publication Data

US 2005/0098132 A1 May 12, 2005

(30) Foreign Application Priority Data

Nov. 12, 2003 (JP) ..... 2003-382544

(51) Int. Cl.
*F01L 1/34* (2006.01)

(52) U.S. Cl. ..... 123/90.17; 123/90.12; 123/90.15; 123/90.31; 464/2; 464/160; 92/5 L

(58) Field of Classification Search ..... 123/90.17; 92/5 L
See application file for complete search history.

(56) References Cited

U.S. PATENT DOCUMENTS 6,330,869 B1 * 12/2001 Yoshiki et al. ..... 123/90.15
6,450,139 B1 * 9/2002 Watanabe ..... 123/90.17
6,505,586 B1 * 1/2003 Sato et al. ..... 123/90.17
6,739,298 B1 * 5/2004 Kusano et al. ..... 123/90.17

FOREIGN PATENT DOCUMENTS

JP 9-217610 8/1997

* cited by examiner

*Primary Examiner*—Thomas Denion
*Assistant Examiner*—Kyle M. Riddle
(74) *Attorney, Agent, or Firm*—Nixon & Vanderhye PC

(57) ABSTRACT

In a valve timing control apparatus, hydraulic oil is supplied into retarding and advancing chambers, and first and second hydraulic chambers, when hydraulic pressure is less than a predetermined pressure and when a phase difference between a most advancing target phase and actual phase of a driver-side rotating member relative to a driven-side rotating member is small. Hydraulic pressure is applied from the first and second hydraulic chambers to the stopper pin, so that the stopper piston is restricted from protruding to the engaging ring before the actual phase coincides with the most advancing target phase. Hydraulic oil is drained from the retarding chamber and the first hydraulic chamber, and hydraulic pressure in the second hydraulic chamber is small, so that the stopper pin protrudes and engages with an engaging ring at the most advancing target phase.

9 Claims, 7 Drawing Sheets

VALVE TIMING CONTROL APPARATUS FOR INTERNAL COMBUSTION ENGINE

CROSS REFERENCE TO RELATED APPLICATIONS

This application is based on and incorporates herein by reference Japanese Patent Application No. 2003-382544 filed on November 12.

FIELD OF THE INVENTION

The present invention relates to a valve timing control apparatus that controls opening timing and closing timing of at least one of an intake valve and an exhaust valve of an internal combustion engine.

BACKGROUND OF THE INVENTION

Conventionally, a valve timing control apparatus, such as a vane-type control apparatus, hydraulically controls a valve timing of at least one of an intake valve and an exhaust valve. A camshaft is driven by a timing pulley or a chain sprocket synchronized with a crankshaft of an engine. Phase difference, i.e., an angular strain is generated between the camshaft and the timing pulley or the chain sprocket in the valve timing control apparatus to control the valve timing.

According to JP-A-9-217610, a stopper piston, which is received in a vane rotor, engages with an engaging hole formed in a housing member at a predetermined angular position, so that the vane rotor is restricted from rotating with respect to the housing member in a hydraulic vane-type control apparatus.

The stopper piston is forced by at least one of retarding hydraulic pressure and advancing hydraulic pressure, so that the stopper piston is pulled out of the engaging hole. Retarding hydraulic pressure is applied to the vane rotor on the retarding angular side. Advancing hydraulic pressure is applied to the vane rotor on the advancing angular side. Both the retarding hydraulic pressure and the advancing hydraulic pressure are applied to the stopper piston in the structure in JP-A-9-217610.

When the phase control direction is changed from the retarding angular side to the advancing angular side, both retarding and advancing hydraulic pressure are applied to the vane rotor. Subsequently, one of the retarding and advancing hydraulic pressure is reduced, so that the phase of the vane rotor is controlled to the retarding angular side or the advancing angular side. When the direction of the phase control is changed, both retarding and advancing hydraulic pressure are maintained such that the stopper piston is forced in the direction, in which the stopper piston is pulled out of the engaging hole. Therefore, the stopper piston is protected from moving to the engaging hole.

As shown in FIGS. 8A to 8C, a stopper piston 310 engages with an engaging hole 303, so that a vane rotor 304 is restricted from rotating with respect to a housing 300. In detail, when the angle of the vane rotor 304 reaches at a predetermined angle, which corresponds to a target phase PT, the stopper piston 310 engages with the engaging hole 303 formed in an engaging ring 302. Alternatively, the stopper piston 310 is forced by advancing hydraulic pressure, which is applied in a hydraulic chamber 320, and retarding hydraulic pressure, which is applied in a hydraulic chamber 322, so that the stopper piston 310 is pulled out of the engaging hole 303. As shown in FIG. 8A, when either retarding or advancing hydraulic pressure is applied to rotate the vane rotor 304 by a predetermined angle with respect to the housing 300, either advancing hydraulic pressure in the hydraulic chamber 320 or retarding hydraulic pressure in the hydraulic chamber 322 is applied to the stopper piston 310 in a direction, in which the stopper piston 310 is pulled out of the engaging ring 302. When temperature of hydraulic oil is high, viscosity of hydraulic oil decreases, and hydraulic pressure decreases. In this situation, when the angle of the vane rotor approaches the predetermined angle, the stopper piston 310 is urged by a spring 312, and protruded on the side of the engaging ring 302.

When a camshaft opens and closes an intake valve and an exhaust valve, the camshaft receives fluctuating torque. The fluctuating torque changes between the retarding angular side and the advancing angular side with respect to a crankshaft, and the vane rotor 304 is rotated to the retarding and advancing angular sides relative to the housing 300 due to the fluctuating torque. The stopper piston 310 collides against the inner wall of the engaging ring 302 (FIG. 8B). Subsequently, the stopper piston 310 engages with the engaging ring 302 (FIG. 8C) when the vane rotor is rotated toward the predetermined angular position due to fluctuating torque. As a result, the stopper piston 310 and the engaging ring 302 may be worn.

Alternatively, when the phase of the vane rotor 304 is controlled from the predetermined angular position to a target position with respect to the housing 300, retarding or advancing hydraulic pressure is applied to the vane rotor 304. Either hydraulic pressure in the hydraulic chamber 320 or hydraulic pressure in the hydraulic chamber 322 is applied to the stopper piston 310, so that the stopper piston 310 is pulled out of the engaging ring 302. In this situation, the vane rotor 304 may be rotated to the target angular position with respect to the housing 300 before the stopper piston 310 is completely pulled out of the engaging ring 302. As a result, the stopper piston 310 collides against the inner wall of the engaging ring 302 (FIG. 8B), and the stopper piston 310 and the engaging ring 302 may be worn.

In JP-A-9-217610, phase of the vane rotor 304 is controlled from a predetermined angular position to a target angular position when the engine is started. However, the phase control in JP-A-9-217610 is not performed by changing a phase control direction. Accordingly, the vane rotor 304 is controlled from the predetermined angular position to the target phase (target position) by either retarding hydraulic pressure or advancing hydraulic pressure. Therefore, the stopper piston 310 may collide against the inner wall of the engaging ring 302.

In another conventional valve timing control apparatus, the hydraulic chamber 322 is not formed, and the stopper piston 310 is pulled out of the engaging ring 302 by retarding hydraulic pressure in the hydraulic chamber 320. The stopper piston 310 engages with the engaging ring 302 at the most advancing position in the valve timing control apparatus. When the vane rotor 304 is rotated from the most advancing position to the retarding angular side, retarding pressure is generated in the hydraulic chamber 320 in a direction, in which the stopper piston 310 is pulled out of the engaging ring 302. In this structure, when only advancing pressure is applied to the vane rotor 304 to rotate the vane rotor 304 toward the most advancing angular position, retarding pressure is not applied from the hydraulic chamber 320 to the stopper piston 310. Accordingly, when the vane rotor 304 approaches to the most advancing angular position, the stopper piston 310 is urged by a spring 312, and is protruded into the engaging ring 302. As a result, the stopper piston 310 may collide against the inner wall of the engaging ring 302 by fluctuating torque applied to the vane rotor 304.

Furthermore, when the phase of the vane rotor 304 is controlled from the most advancing angular position, in which the stopper piston 310 engages with the engaging ring 302, to the retarding angular side, retarding pressure is applied to the vane rotor 304. The retarding pressure is also applied to the stopper piston 310, in a direction in which the stopper piston 310 is pulled out of the engaging ring 302. In this situation, when the vane rotor 304 is rotated to the retarding angular side before the stopper piston 310 is completely pulled out of the engaging ring 302, the stopper piston 310 collides against the inner wall of the engaging ring 302.

SUMMARY OF THE INVENTION

In view of the foregoing problems, it is an object of the present invention to produce a valve timing control apparatus that has a structure, in which components constituting a restricting means, which restricts relative rotation between a driver-side rotating member and a driven-side rotating member at a predetermined angular position, can be protected from abrasion.

According to the present invention, a valve timing control apparatus is provided to a power train system, which transmits driving force from a driveshaft of an internal combustion engine to a driven shaft such as a camshaft that opens and closes at least one of an intake valve and an exhaust valve. The valve timing control apparatus controls at least one of open-close timing of the intake valve and open-close timing of the exhaust valve. The valve timing control apparatus includes a driver-side rotating member, a driven-side rotating member, a vane, an engaging member, a restrictively biasing means, a restricting means, a switching valve, and a control means.

The driver-side rotating member rotates in conjunction with the driveshaft of the internal combustion engine. The driven-side rotating member rotates in conjunction with the driven shaft. One of the driver-side rotating member and the driven-side rotating member internally forms a chamber. The vane is provided to the other of the driver-side rotating member and the driven-side rotating member. The vane is received in the chamber such that the vane partitions the chamber into a retarding chamber and an advancing chamber, in which fluid pressure is applied to the driven-side rotating member, so that the driven-side rotating member is rotated to a retarding angular side and an advancing angular side with respect to the driver-side rotating member. One of the driver-side rotating member and the driven-side rotating member defines an engaging hole.

The engaging member is received in the other of the driver-side rotating member and the driven-side rotating member. The engaging member engages with the engaging hole to restrict the driven-side rotating member from rotating with respect to the driver-side rotating member when the driven-side rotating member is at a predetermined angular position with respect to the driver-side rotating member. The restrictively biasing means biases the engaging member in a direction in which the engaging member engages with the engaging hole. The restricting means has at least one of a first hydraulic chamber and a second hydraulic chamber to define a releasing chamber, in which fluid pressure is applied to the engaging member in a direction in which engagement between the engaging member and the engaging hole is released. The first hydraulic chamber communicates with the retarding chamber. The second hydraulic chamber communicates with the advancing chamber.

The switching valve includes a solenoid actuator and a valve member. The valve member is displaced by driving force generated by the solenoid actuator, so that working fluid is supplied to all of the retarding chamber, the advancing chamber and the releasing chamber, alternatively working fluid is drained from the retarding chamber, the advancing chamber and the releasing chamber. The control means controls current supplied to the solenoid actuator.

The control means duty-controls current supplied to the solenoid actuator to control the phase of the driven-side rotating member with respect to the driver-side rotating member. Working fluid is supplied to all of the retarding chamber, the advancing chamber and the releasing chamber, when the driven-side rotating member approaches a predetermined angular position, which corresponds to a target phase, with respect to the driver-side rotating member. Alternatively, the control means duty-controls current supplied to the solenoid actuator to control the phase of the driven-side rotating member with respect to the driver-side rotating member. When the driven-side rotating member rotates from the predetermined angular position to a target phase with respect to the driver-side rotating member, working fluid is supplied to all of the retarding chamber, the advancing chamber and the releasing chamber. Subsequently, working fluid is drained from one of the retarding chamber and the advancing chamber, simultaneously with supplying working fluid into the other of the retarding chamber and the advancing chamber to rotate the driven-side rotating member to the target phase with respect to the driver-side rotating member.

Alternatively, the control means duty-controls current supplied to the solenoid actuator to control the phase of the driven-side rotating member with respect to the driver-side rotating member. When the driven-side rotating member approaches a target phase, which is the predetermined angular position with respect to the driver-side rotating member, working fluid is supplied to all of the retarding chamber, the advancing chamber and the releasing chamber. When the driven-side rotating member rotates from the predetermined angular position to a target phase with respect to the driver-side rotating member, working fluid is supplied to all of the retarding chamber, the advancing chamber and the releasing chamber. Subsequently, working fluid is drained from one of the retarding chamber and the advancing chamber, simultaneously with supplying working fluid into the other of the retarding chamber and the advancing chamber to rotate the driven-side rotating member to the target phase with respect to the driver-side rotating member.

Alternatively, the control means duty-controls current supplied to the solenoid actuator to control the phase of the driven-side rotating member with respect to the driver-side rotating member. When the driven-side rotating member approaches a target phase, which is the predetermined angular position with respect to the driver-side rotating member, working fluid is supplied to all of the retarding chamber, the advancing chamber and the releasing chamber. When the driven-side rotating member rotates from the predetermined angular position to a target phase with respect to the driver-side rotating member, working fluid is supplied to all of the retarding chamber, the advancing chamber and the releasing chamber. Subsequently, working fluid is drained from one of the retarding chamber and the advancing chamber, simultaneously with supplying working fluid into the other of the retarding chamber and the advancing chamber to rotate the driven-side rotating member to the target phase with respect to the driver-side rotating member.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
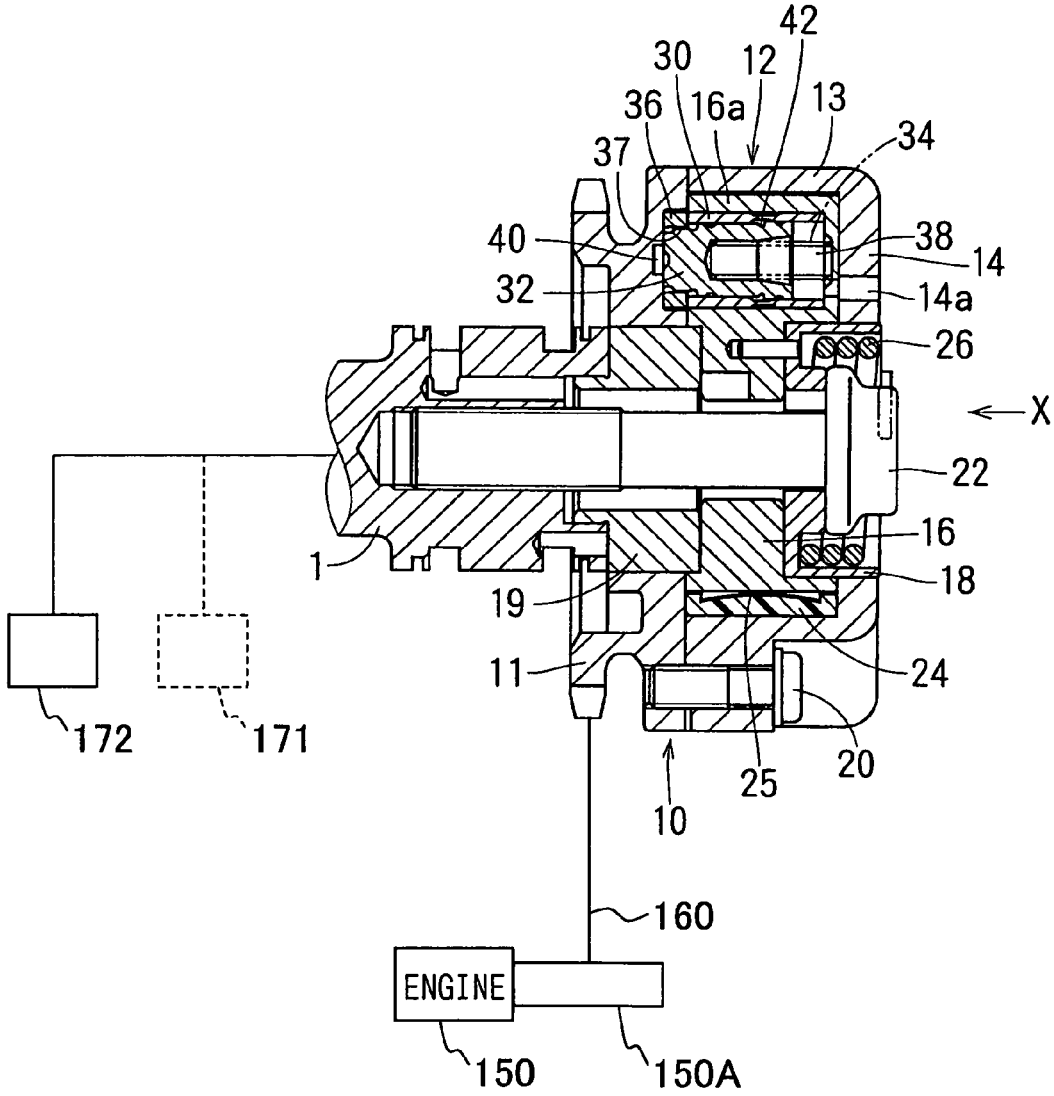
FIG. 1 is a cross-sectional side view showing a valve timing control apparatus according to a first embodiment of the present invention.
Figure 2:
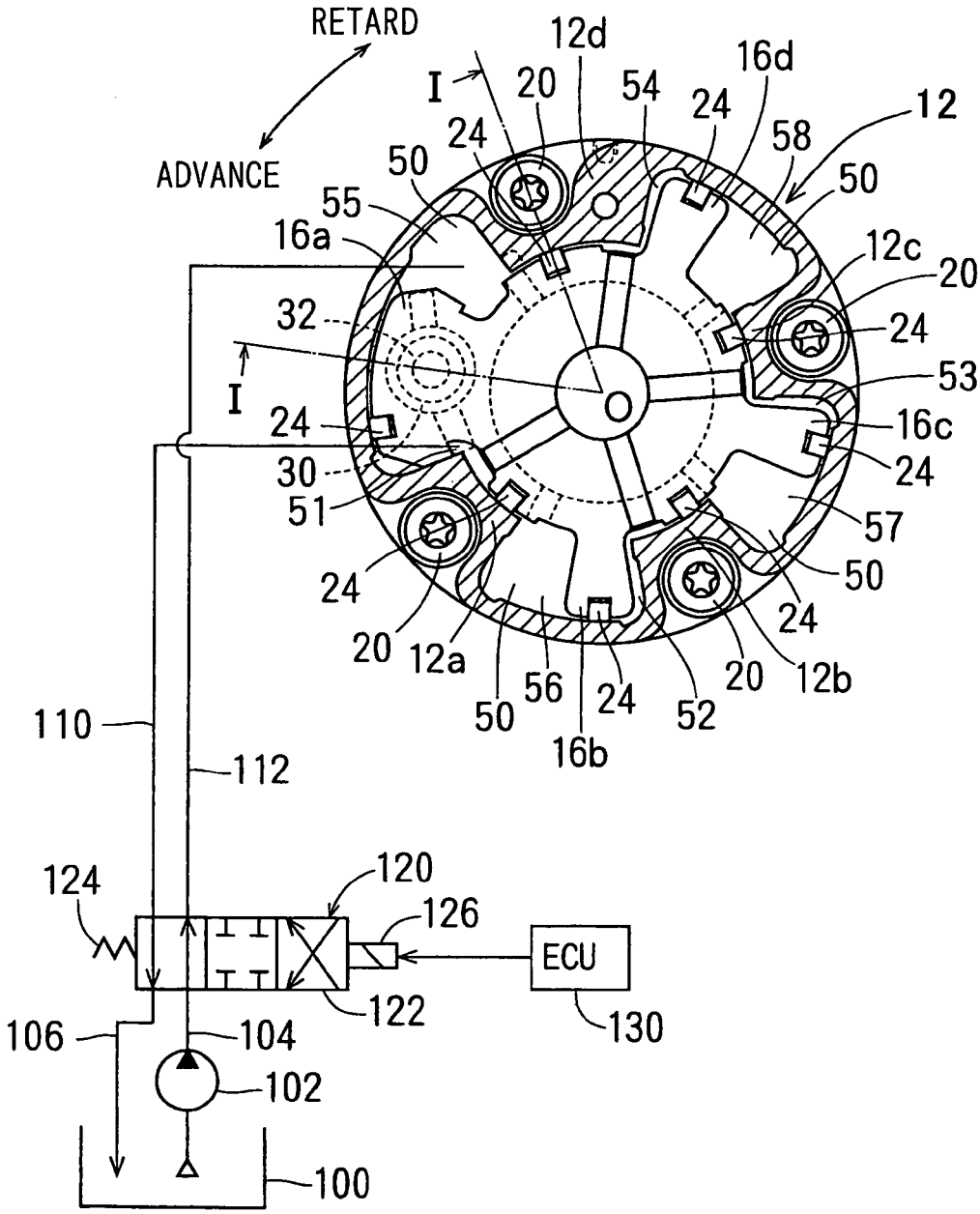
FIG. 2 is a cross-sectional front view showing the valve timing control apparatus according to the first embodiment.

As follows, a structure of a valve timing control apparatus 10 is described in accordance with FIGS. 1, 2. FIG. 1 is a cross-sectional side view showing the valve timing control apparatus 10 taken along with the line I-O-I in FIG. 2. FIG. 2 is a cross-sectional front view showing the valve timing control apparatus 10 taken along with an end face axially on the side of a front plate 14 of a vane rotor 16. The valve timing control apparatus 10 is hydraulically operated to control valve timing of an exhaust valve 172.

As shown in FIG. 1, a chain sprocket 11 is provided to be a sidewall on one axial side of a driver-side rotating member. The chain sprocket 11 is driven by a crankshaft 150A serving as a driveshaft of an engine 150 via a chain 160 serving as a part of a power train system, so that the chain sprocket 11 rotates synchronously with the crankshaft 150A. A camshaft 1 serving as a driven-side rotating member is driven by the chain sprocket 11 via the driver-side rotating member to open and close the exhaust valve 172. The camshaft 1 and the chain sprocket 11 can rotate while defining a phase difference within a predetermined angular range therebetween. The chain sprocket 11 and the camshaft 1 rotate in a counterclockwise direction when being viewed from the side of the arrow X in FIG. 1. The counterclockwise direction is oriented to an advancing angular side.

The chain sprocket 11 and a shoe housing 12 are screwed to each other using a bolt 20, and coaxially secured to each other to construct a housing member serving as a driver-side rotating member. The shoe housing 12 is integrally formed of a circumferential wall 13 and the front plate 14. The front plate 14 is a sidewall located on the other axial side of the housing member, which is on the axially opposite side as the chain sprocket 11.

As shown in FIG. 2, the shoe housing 12 has shoes 12*a*, 12*b*, 12*c*, 12*d* that respectively protrude radially internally from the circumferential wall 13 of the shoe housing 12. The shoes 12*a*, 12*b*, 12*c*, 12*d* are substantially uniformly spaced from each other along the circumferential wall 13. Four sector-shaped chambers 50 are circumferentially formed in the shoe housing 12. Specifically, the four sector-shaped chambers 50 are formed in gaps defined between two of the shoes 12*a*, 12*b*, 12*c*, 12*d*, which are adjacent to each other. Each sector-shaped chamber 50 receives one of vanes 16*a*, 16*b*, 16*c*, 16*d*. The vanes 16*a*, 16*b*, 16*c*, 16*d* serve as vane members. Each shoe 12*a*, 12*b*, 12*c*, 12*d* has a radially inner circumferential face that has an arc-shaped cross section.

The vane rotor 16 serving as a driven-side rotating member has the vanes 16*a*, 16*b*, 16*c*, 16*d* that are arranged circumferentially substantially in uniform on the radially outer side of the vane rotor 16. Each vane 16*a*, 16*b*, 16*c*, 16*d* is rotatable in the corresponding sector-shaped chamber 50. Each vane 16*a*, 16*b*, 16*c*, 16*d* partitions each sector-shaped chamber 50 into a retarding hydraulic chamber 51, 52, 53, 54 and an advancing hydraulic chamber 55, 56, 57, 58. The arrows showing the retarding angular side and the advancing angular side respectively represent a retarding angular direction and an advancing angular direction of the vane rotor 16 with respect to the shoe housing 12, i.e., the chain sprocket 11.

Referring back to FIG. 1, the vane rotor 16, a front bush 18 and a rear bush 19 serve as a driven-side rotating member in this embodiment. The vane rotor 16, the front bush 18 and the rear bush 19 are integrally secured to the camshaft 1 using a bolt 22. The camshaft 1, the vane rotor 16, the front bush 18 and the rear bush 19 are coaxially rotatable with respect to the chain sprocket 11 and the shoe housing 12, i.e., driver-side rotating member.

Referring back to FIG. 2, seal members 24 respectively engage with notches formed in the outer circumferential periphery of the vane rotor 16. The outer circumferential periphery of the vane rotor 16 and the inner circumferential periphery of the circumferential wall 13 form small clearances therebetween. Each seal member 24 restricts hydraulic oil (working fluid) from leaking between each retarding hydraulic chamber 51, 52, 53, 54 and each advancing hydraulic chamber 55, 56, 57, 58, which are adjacent to each other, through the small clearances circumferentially formed between the vane rotor 16 and the circumferential wall 13. Each seal member 24 is radially outwardly urged onto the circumferential wall 13 of the shoe housing 12 by one of blade springs 25, as shown in FIG. 1.

A coil spring 26 serving as an advancingly angular urging means hooks to the shoe housing 12 on one end, and hooks to the vane rotor 16 on the other end. Resilient force of the coil spring 26 works as torque that rotates the vane rotor 16 to the advancing angular side with respect to the shoe housing 12. Load torque is applied to the camshaft 1 when the camshaft 1 opens and closes the exhaust valve 172, and the load torque fluctuates between the positive and negative directions of the load torque. Here, the positive direction of the load torque represents the retarding angular direction of the vane rotor 16 with respect to the shoe housing 12. The negative direction of the load torque represents the advancing angular direction of the vane rotor 16 with respect to the shoe housing 12. An average of the load torque works in the positive direction, i.e., the retarding angular direction. The coil spring 26 applies torque to the vane rotor 16 in the advancing angular direction. The torque applied to the vane rotor 16 by the coil spring 26 in the advancing angular direction is substantially the same as the average of the load torque applied to the camshaft 1 in the retarding angular direction. The vane rotor 16 is secured to the camshaft 1. That is, the average of load torque in the retarding angular direction substantially balances with the torque applied by the coil spring 26 in the advancing angular direction.

A guide ring 30 is press-inserted into the inner wall of the vane 16*a* that internally forms a receiving chamber 38. A cylindrical stopper piston 32 serving as an engaging member is received in the guide ring 30 such that the stopper piston 32 is slidable in a substantially axial direction of the camshaft 1. A spring 34 serving as a restrictively biasing means axially urges the stopper piston 32 to an engaging ring 36 that is press-inserted into the chain sprocket 11. The engaging ring 36 internally has an engaging hole 37, and the stopper piston 32 can engage with the engaging hole 37.

The front end portion of the stopper piston 32, which is axially on the side of the engaging ring 36, preferably has a tapered shape such that the outer diameter of the front end portion of the stopper piston 32 axially decreases in a direction, in which the stopper piston 32 engages with the engaging ring 36. The engaging hole 37 of the engaging ring 36 also preferably has a tapered shape such that the tapered shape of the engaging hole 37 has a substantially same cone angle (taper angle) corresponding to the cone angle of the taper-shaped front end portion of the stopper piston 32. Thus, the stopper piston 32 can smoothly engage with the engaging ring 36.

When the stopper piston 32 engages with the engaging ring 36, the vane rotor 16 is restricted from rotating with respect to the chain sprocket 11 and the shoe housing 12. The stopper piston 32 engages with the engaging ring 36 at a predetermined angular position, which corresponds to a substantially optimum phase of the camshaft 1 with respect to the crankshaft 150A for staring the engine 150. The predetermined angular position corresponds to the most advancing angular position of the valve timing control apparatus 10 that controls valve timing of the exhaust valve 172 of the engine 150.

The receiving chamber 38, which is located on the axially opposite side as the engaging ring 36 with respect to the stopper piston 32, communicates with a through hole 14*a* formed in the front plate 14, 50 that the receiving chamber 38 communicates with atmosphere via the through hole 14*a* at the most advancing angular position. Therefore, air received in the receiving chamber 38 can vent via the through hole 14*a* when the camshaft 1 is at the most advancing angular position with respect to the crankshaft 150A, so that reciprocating motion of the stopper piston 32 is not restricted.

A first hydraulic chamber 40, which is formed on the side of the engaging ring 36 with respect to the stopper piston 32, communicates with the retarding hydraulic chamber 51. A second hydraulic chamber 42, which is formed around the outer circumferential periphery of the stopper piston 32, communicates with the advancing hydraulic chamber 55. Hydraulic pressure (fluid pressure) in the first and second hydraulic chambers 40, 42 works in the direction, in which the stopper piston 32 is pulled out of the engaging ring 36. Each of the first and second hydraulic chambers 40, 42 serves as a releasing chamber. The stopper piston 32, the spring 34, the engaging hole 37, the first and second hydraulic chambers 40, 42 serve as a restricting means.

Referring back to FIG. 2, the retarding hydraulic chamber 51 is formed between the shoe 12*a* and the vane 16*a*. The retarding hydraulic chamber 52 is formed between the shoe 12*b* and the vane 16*b*. The retarding hydraulic chamber 53 is formed between the shoe 12*c* and the vane 16*c*. The retarding hydraulic chamber 54 is formed between the shoe 12*d* and the vane 16*d*.

The advancing hydraulic chamber 55 is formed between the shoe 12*d* and the vane 16*a*. The advancing hydraulic chamber 56 is formed between the shoe 12*a* and the vane 16*b*. The advancing hydraulic chamber 57 is formed between the shoe 12*b* and the vane 16*c*. The advancing hydraulic chamber 58 is formed between the shoe 12*c* and the vane 16*d*.

An oil supply passage 104 is connected with an oil pump 102. An oil drain passage 106 is opened to a drain 100. The oil pump 102 pumps hydraulic oil from the drain 100 respectively to the hydraulic chambers 51, 52, 53, 54, 55, 56, 57, 58 through a switching valve 120, an oil passage 110 or an oil passage 112. FIG. 2 shows only a connection between the oil passage 110 and the retarding hydraulic chamber 51, and a connection between the oil passage 112 and the advancing hydraulic chamber 55. However, the oil passage 110 communicates with the retarding hydraulic chambers 51, 52, 53, 54 and the first hydraulic chamber 40, and the oil passage 112 communicates with the advancing hydraulic chambers 55, 56, 57, 58 and the second hydraulic chamber 42, in addition to the connections in FIG. 2.

The switching valve 120 includes a spool 122, a spring 124, and a solenoid actuator 126. The solenoid actuator 126 includes a coil to generate electromagnetic force that displaces the spool 122 serving as a valve member against resiliency of the spring 124. An ECU (engine control unit, electronic control unit) 130 serving as a control means executes phase control routines shown in FIGS. 4 and 5. The ECU 130 supplies current to the solenoid actuator 126 under duty control, so that the position of the spool 122 is controlled.

That is, the ECU 130 operates ON-OFF current supplied to the solenoid actuator 126 under the duty control, i.e., the ECU 130 operates ON-OFF current under a PWM (pulse width modulation) control.

When current supplied to the solenoid actuator 126 is turned off, that is, when duty D of current supplied to the solenoid actuator 126 is changed to be 0%, the spool 122 is urged by the spring 124 to be in the position shown in FIG. 2.

Next, a phase control routine of the valve timing control apparatus 10 is described.

Figure 6:
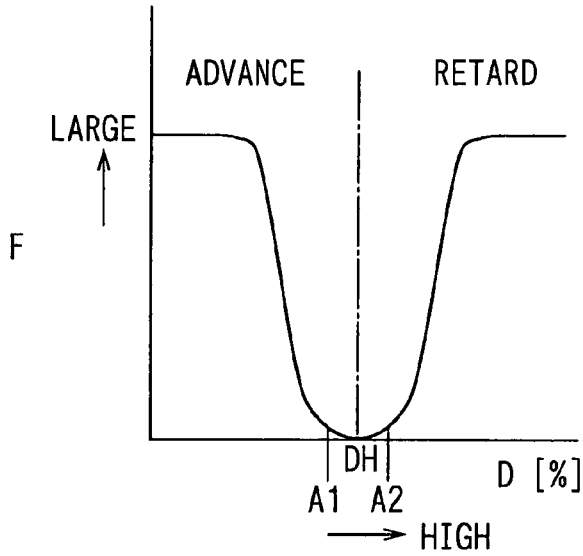
FIG. 6 is a graph showing a relationship between duty D and a flow amount F according to the first embodiment.

Duty D in FIG. 6 corresponds to current that is duty-controlled by ECU 130, and is supplied to the solenoid actuator 126 of the switching valve 120. The flow amount F in FIG. 6 corresponds to a flow amount of hydraulic oil supplied into each retarding hydraulic chamber 51, 52, 53, 54 and each advancing hydraulic chamber 55, 56, 57, 58. When the phase (actual phase PA) of the camshaft 1 relative to the crankshaft 150A is controlled using a normal feed back (F/B) control, duty D of current supplied to the solenoid actuator 126 is controlled in accordance with deviation an actual phase (present phase) PA of the camshaft 1 relative to the crankshaft 150A and a target phase PT of the camshaft 1 relative to the crankshaft 150A. Specifically, when deviation between actual phase PA and the target phase PT is large, a flow amount F of hydraulic oil supplied to the retarding angular side, i.e., the retarding hydraulic chambers 51, 52, 53, 54 or the advancing angular side, i.e., advancing hydraulic chamber 55, 56, 57, 58 is increased.

Thus, actual phase PA rapidly approaches the target phase PT in the feedback control. When deviation between actual phase PA and the target phase PT becomes small, flow amount F of hydraulic oil supplied to the retarding angular side or the advancing angular side is decreased, so that actual phase PA gradually precisely approaches the target phase PT in the feedback control.

Figure 4:
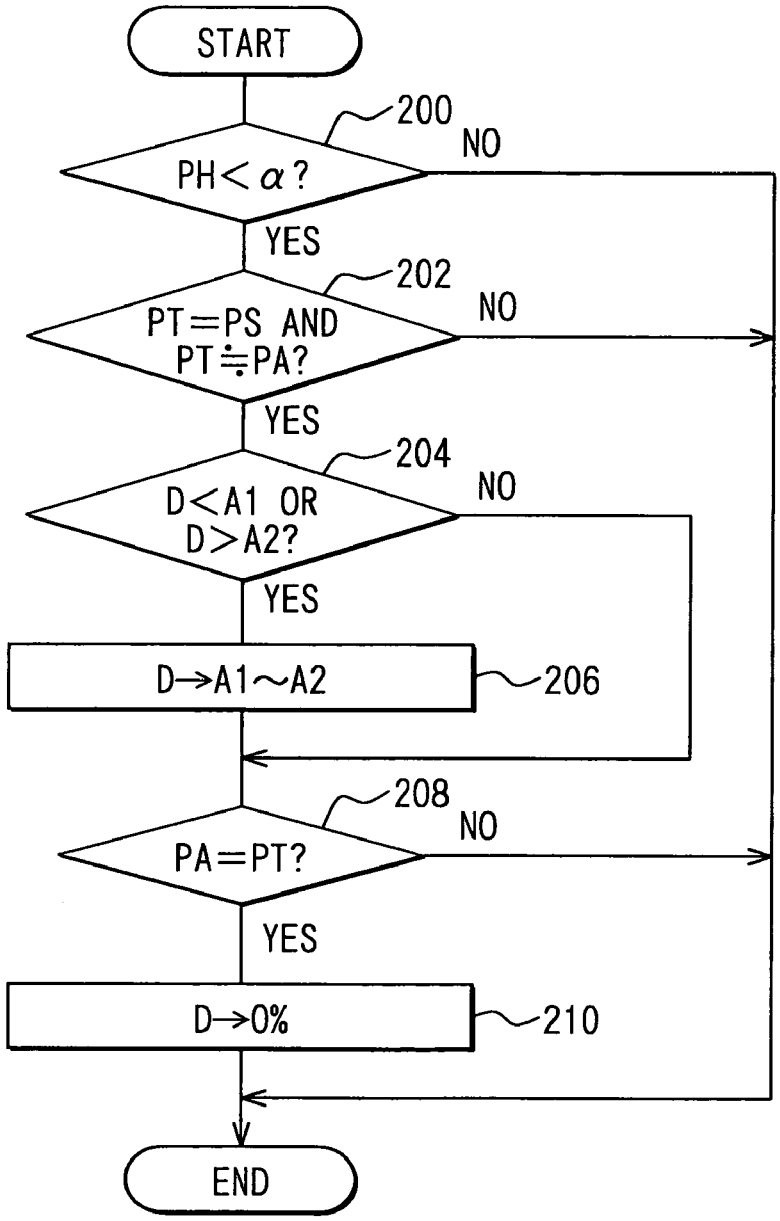
FIG. 4 is a flowchart showing a first phase control routine of the valve timing control apparatus according to the first embodiment.

Next, a first phase control routine is described in accordance with FIGS. 1, 4 and 6. The target phase PT of the vane rotor 16 with respect to the shoe housing 12 is set to be the starting phase PS, i.e., most advancing position, in the first phase control routine.

As shown in FIG. 4, at step 200, temperature of hydraulic oil is determined in accordance with a detection signal of hydraulic temperature sensor. When temperature of hydraulic oil is determined to be high, viscosity of hydraulic oil is determined to be low, and hydraulic pressure PH is determined to be low. When, hydraulic pressure PH, which is estimated based on hydraulic temperature, is determined to be less than a predetermined pressure $\alpha$, the routine proceeds to step 202. When hydraulic pressure PH is determined to be greater than the predetermined pressure at step 200, the first phase control routine is terminated.

At step 202, when the target phase PT is the starting phase PS, and when deviation between the target phase PT and actual phase PA is determined to be small, that is, when actual phase PA is determined to be in the vicinity of the target phase PT, the routine proceeds to step 204. When deviation between the target phase PT and actual phase PA is determined to be large at step 202, the routine is terminated.

At step 204, when duty D is determined to be less than A1 or duty D is determined to be greater than A2, the routine proceeds to step 206, in which duty D is set to be equal to or greater than A1 and is set to be equal to or less than A2, i.e., $A1 \leqq D \leqq A2$. The A1 and A2 respectively correspond to A1 and A2 in FIG. 6.

When duty D is in the range $A1 \leqq D \leqq A2$, both supply of hydraulic oil into each retarding hydraulic chamber 51, 52, 53, 54 and supply of hydraulic oil into each advancing hydraulic chamber 55, 56, 57, 58 are not completely stopped. Therefore, hydraulic oil is supplied into the first and second hydraulic chambers 40, 42, as well as each retarding hydraulic chamber 51, 52, 53, 54 and each advancing hydraulic chamber 55, 56, 57, 58. Therefore, the stopper piston 32 does not protrude to the side of the engaging ring 36. When duty D is less than A1 or duty D is greater than A2, hydraulic oil is supplied into either the retarding hydraulic chambers 51, 52, 53, 54 or the advancing hydraulic chambers 55, 56, 57, 58. In a normal phase control, i.e., in the feedback control, the phase control is performed in the ranges, in which duty D is less than A1 and duty D is greater than A2, before actual phase PA coincides with at the target phase PT.

At step 204, when duty D is in the range $A1 \leqq D \leqq A2$, i.e., a negative determination is made at step 204, the routine proceeds to step 208.

At step 208, when actual phase PA is determined to be the same as the target phase PT, that is, when actual phase PA of the vane rotor 16 coincides with the target phase PT, i.e., the starting phase PS, the routine proceeds to S210.

At step 210, the ECU 130 sets duty D at 0%. That is, the ECU 130 controls current supplied to the switching valve 120 such that hydraulic oil is supplied to each advancing hydraulic chambers 55, 56, 57, 58 and the second hydraulic chamber 42, and hydraulic oil is drained from each retarding hydraulic chambers 51, 52, 53, 54 and the first hydraulic chamber 40. Here, the ECU 130 may set duty D at 100%, depending on the structure of the switching valve 120, i.e., depending on the valve-action structure such as direct action or reverse action.

Figure 3A:
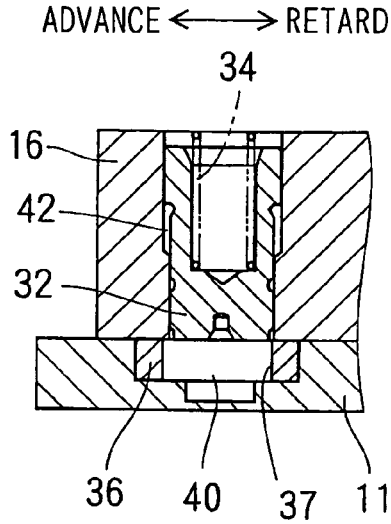
FIGS. 3A to 3C are cross-sectional side views showing a relative positions between a stopper piston and an engaging hole of the valve timing control apparatus according to the first embodiment.
Figure 3B:
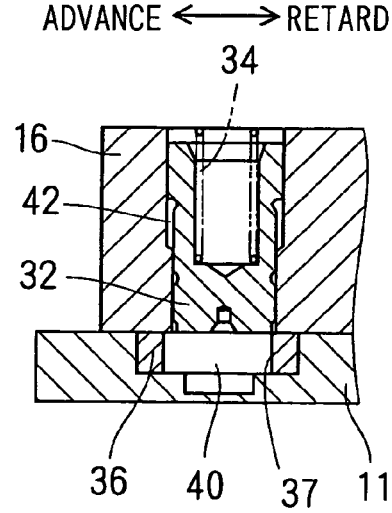
Figure 3C:
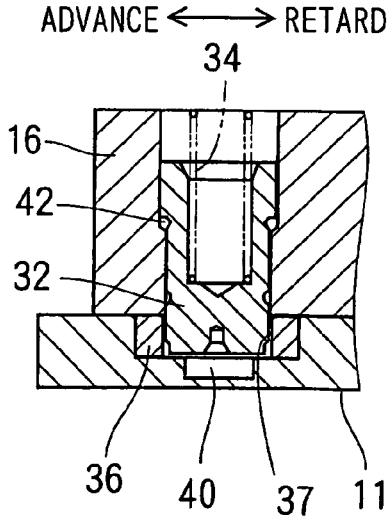

Step 210 is executed when hydraulic pressure PH is equal to or less than the predetermined value $\alpha$. Force applied from the second hydraulic chamber 42 to the stopper piston 32 in the direction, in which the stopper piston 32 is pulled out of the engaging ring 36, becomes small, when hydraulic oil is drained from the first hydraulic chamber 40, even when hydraulic oil is supplied into the second hydraulic chamber 42. Therefore, the stopper piston 32 engages with the engaging ring 36 (FIG. 3C). At step 208, when actual phase PA is different from the starting phase PS, i.e., actual phase PA does not reach at the starting phase PS, the routine is terminated.

When actual phase PA does not coincide with the target phase PT, i.e., the starting phase PS, duty D is controlled in the range, in which duty D is less than A1 or duty D is greater than A2. Thus, a flow amount F of hydraulic oil, which drives the vane rotor 16 to the starting phase PS, is increased, so that actual phase PA of the vane rotor 16 quickly reaches at the vicinity of the starting phase PS, i.e., the target phase PT. When actual phase PA reaches at the vicinity of the target phase PT, duty D is set in the range $A1 \leqq D \leqq A2$ that is in the vicinity of the holding duty DH. In this situation, hydraulic oil is supplied into each retarding hydraulic chamber 51, 52, 53, 54 and each advancing hydraulic chamber 55, 56, 57, 58, and actual phase PA gradually approaches the target phase PT, i.e., the starting phase PS.

Figure 7:
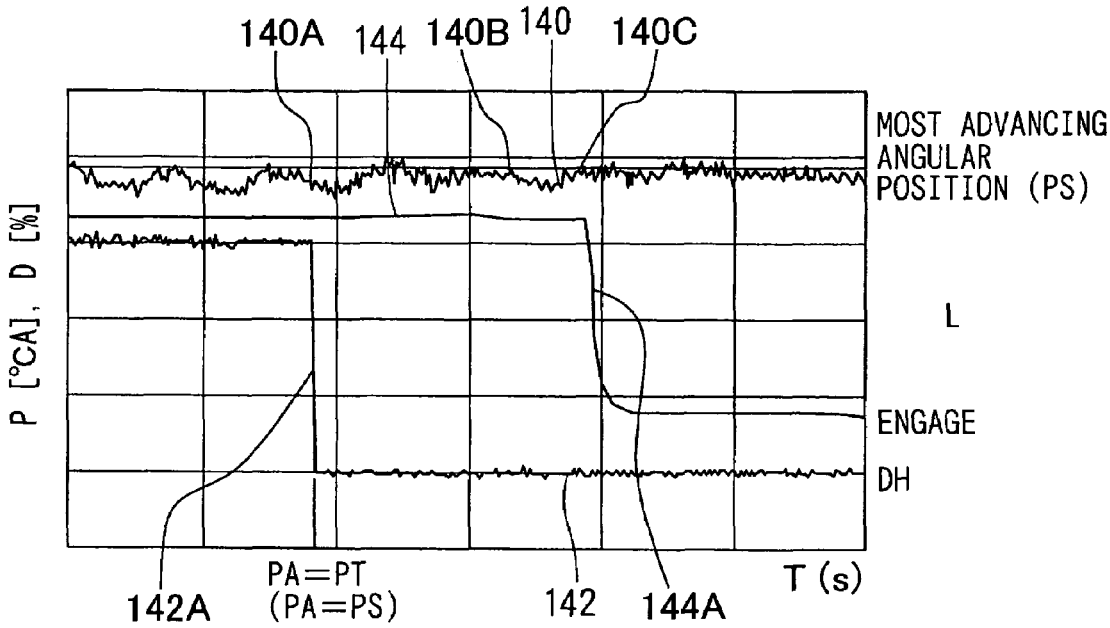
FIG. 7 is a graph showing a relationship among a phase P, duty D, a piston position L and time T, according to the first embodiment.
Figure 8A:
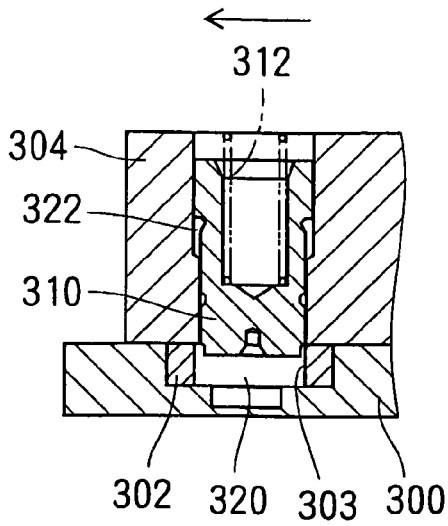
FIG. 8A PRIOR ART
FIGS. 8A to 8C are cross-sectional side views showing a relative positions between a stopper piston and an engaging hole of a valve timing control apparatus according to a prior art.
Figure 8B:
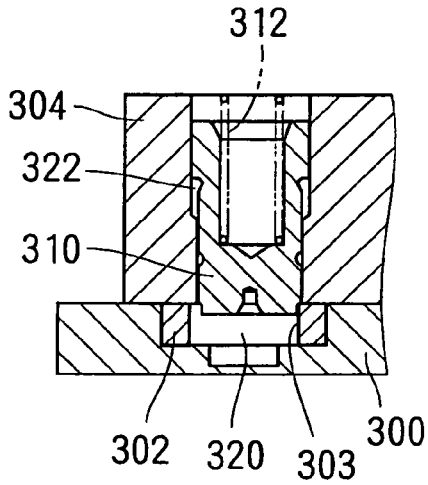
FIG. 8B PRIOR ART
Figure 8C:
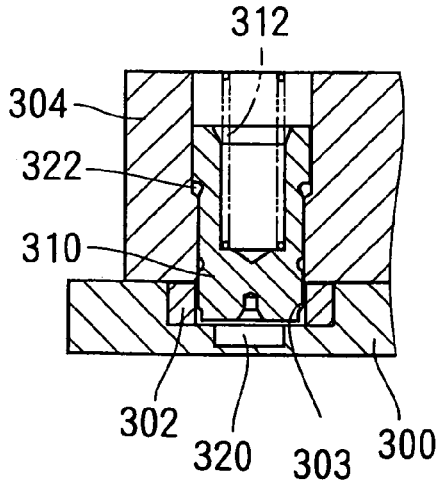
FIG. 8C PRIOR ART

FIG. 7 shows a relationship among actual phase 140 (PA), which reaches at the most advancing angular position, i.e., the starting phase PS, duty 142 (D), and piston position 144 (L) of the stopper piston 32. When actual phase 140 reaches at the most advancing angular position (PS), i.e., target phase PT as shown by 140A under the feed back control, the duty D is set in the range $A1 \leqq D \leqq A2$ that is in the vicinity of the holding duty DH. In this situation, duty D deceases as shown by 142A, and hydraulic oil is supplied into each retarding and advancing hydraulic chambers 51, 52, 53, 54, 55, 56, 57, 58, so that hydraulic oil is supplied into the first and second hydraulic chambers 40, 42. Therefore, the stopper piston 32 is forced by hydraulic pressure in both the first and second hydraulic chambers 40, 42, and the stopper piston 32 does not protrude to the engaging ring 36 (FIGS. 3A, 3B), even when hydraulic pressure PH is less than the predetermined pressure $\alpha$.

Subsequently, actual phase 140 is gradually precisely controlled to reach at the starting phase PS as shown by 140B, so that actual phase 140 converges to the most advancing angular position (PS), after duty D deceases in the vicinity of the holding duty DH. When actual phase 140 reaches at the starting phase PS, i.e., the most advancing angular position as shown by 140C, the piston position 144 decreases as shown by 144A, so that the stopper piston 32 engages with the engaging ring 36. In this situation, the vane rotor 16 is substantially fixed to the chain sprocket 11 and the shoe housing 12, so that the actual phase 140 stably substantially coincides with the starting phase PS.

In the first phase control routine shown in FIG. 4, when hydraulic pressure PH is less than the predetermined pressure $\alpha$, and when the actual phase 140 reaches at the starting phase PS, i.e., the target phase PT, duty D is set in the range $A1 \leqq D \leqq A2$ that is in the vicinity of the holding duty DH. Hydraulic oil is supplied into the first and second hydraulic chambers 40, 42, before actual phase 140 reaches at the starting phase PS. Thus, the stopper piston 32 can be restricted from protruding into the engaging ring 36 when actual phase 140 reaches at the starting phase PS, so that the stopper piston 32 can be protected from colliding against the engaging hole 37 when fluctuating torque is applied to the vane rotor 16. Therefore, the stopper piston 32 and the engaging ring 36 can be protected from abrasion.

In the first phase control routine shown in FIG. 4, when hydraulic pressure PH is greater than the predetermined pressure α, only step 200 is executed and the first phase control routine is terminated. In the above structure, both retarding and advancing hydraulic pressure are applied to the stopper piston 32 in a direction, in which the stopper piston 32 is pulled out of the engaging hole 37. Accordingly, when hydraulic pressure PH is greater than the predetermined pressure α, the stopper piston 32 does not protrude to the engaging ring 36, as long as either the retarding or advancing hydraulic pressure is applied to the stopper piston 32. Therefore, when hydraulic pressure PH is greater than the predetermined pressure α, the main part of first phase control routine, i.e., steps 202 to 210 need not to be executed.

When hydraulic pressure PH is greater than the predetermined pressure α, the normal phase control, i.e., feedback control is performed. That is, duty D of current supplied to the switching valve 120 is controlled such that the vane rotor 16 quickly reaches at the vicinity of the starting position (starting phase PS). Thus, actual phase PA can quickly reach at the starting phase PS, so that response of the phase control can be enhanced.

Next, a second phase control routine, in which the vane rotor 16 is rotated from the most advancing position, i.e., starting phase PS to the target phase PT, is described. In the second phase control routine, when the starting phase PS is different from the target phase PT, the main portion of the second phase control routine is executed.

Figure 5:
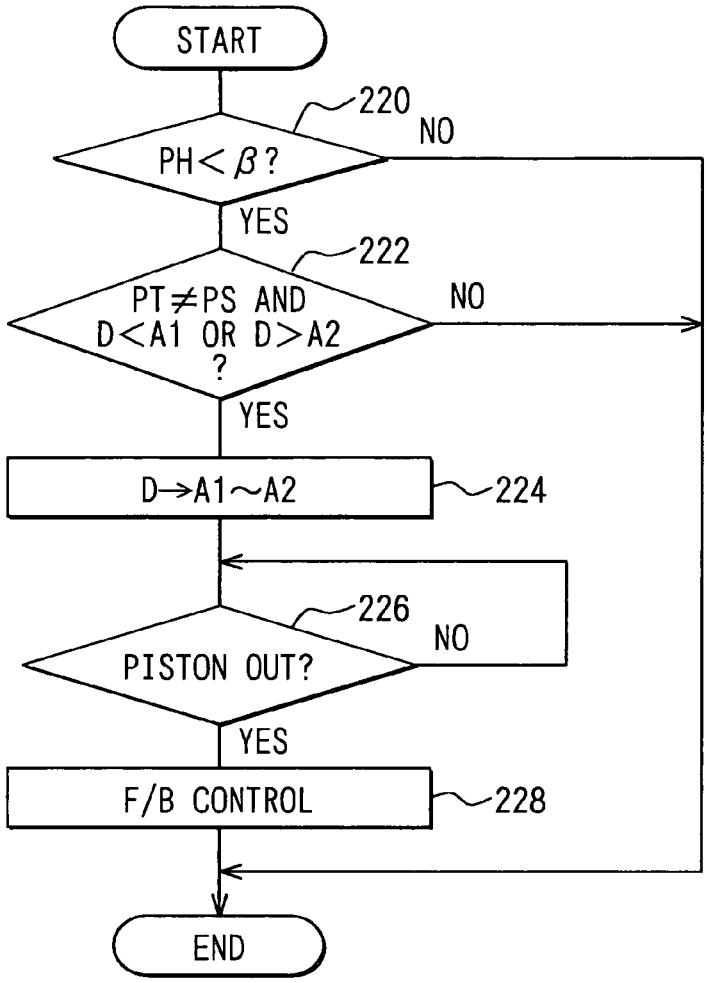
FIG. 5 is a flowchart showing a second phase control routine of the valve timing control apparatus according to the first embodiment.

As shown in FIG. 5, at step 220, when hydraulic pressure PH is determined to be less than the predetermined pressure β, the routine proceeds to step 222. At step 220, when hydraulic pressure PH is determined to be greater than the predetermined pressure β, the routine is terminated.

At step 222, when the target phase PT is not the starting phase PS, i.e., the target phase PT is changed from the starting phase PS, and when duty D (initial duty) is determined to be less than A1, i.e., $D<A1$ or the duty D is determined to be greater than A2, i.e., $D>A2$, the routine proceeds to step 224. At step 224, duty D is set in the range $A1 \leqq D \leqq A2$, and the routine proceeds to step 226. At step 222, when the target phase PT is the same as the starting phase PS, or when duty D is in the range $A1 \leqq D \leqq A2$, this second phase control routine is terminated.

At step 226, the routine waits for a predetermined period. The predetermined period at step 226 is determined to be a sufficient period, in which the stopper piston 32 can be completely pulled out of the engaging ring 36. When duty D is set in the range $A1 \leqq D \leqq A2$, the vane rotor 16 does not quickly rotate with respect to the shoe housing 12 from the most advancing position, i.e., the starting phase PS to the retarding angular side. The stopper piston 32 is pulled out of the engaging ring 36, and the routine proceeds to step 228, in which the normal phase control, i.e., the feedback control is performed to control the phase of the camshaft 1 relative to the crankshaft 150A.

In the second phase control routine shown in FIG. 5, when hydraulic pressure PH is equal to or less than the predetermined pressure β, duty D is set in the range $A1 \leqq D \leqq A2$ that is in the vicinity of the holding duty DH for the predetermined period, in which the stopper piston 32 is pulled out of the engaging ring 36. In this situation, hydraulic oil is supplied into each retarding and advancing hydraulic chambers 51, 52, 53, 54, 55, 56, 57, 58 in the beginning of rotation of the vane rotor 16 from the starting phase PS to the target phase PT, which is different from the starting phase PS. Therefore, the vane rotor 16 is restricted from quickly rotating from the most advancing position, i.e., starting phase PS to the retarding angular side. Furthermore, hydraulic oil is supplied into the first and second hydraulic chambers 40, 42, so that the stopper piston 32 can be pulled out of the engaging ring 36, even when hydraulic pressure PH is equal to or less than the predetermined pressure β. Therefore, in the beginning of rotation of the vane rotor 16 from the starting phase PS to the target phase PT, the stopper piston 32 is pulled out of the engaging ring 36, before the stopper piston 32 collides against the engaging hole 37. Thus, the stopper piston 32 and the engaging ring 36 can be protected from abrasion.

In the second phase control routine shown in FIG. 5, when hydraulic pressure PH is greater than the predetermined pressure β, only step 220 is executed and the routine is terminated. In the above structure, when hydraulic pressure PH is greater than the predetermined pressure β, the stopper piston 32 is pulled out of the engaging ring 36 by either the retarding or advancing hydraulic pressure, before the vane rotor 16 rotates from the starting phase PS to the retarding angular side.

When hydraulic pressure PH is greater than the predetermined pressure β, the normal phase control, i.e., feedback control is performed. That is, duty D of current supplied to the switching valve 120 is controlled such that the vane rotor 16 quickly reaches at the target phase PT from the starting phase PS. Thus, when hydraulic pressure PH is greater than the predetermined pressure β, the main portion of the second phase control routine shown in FIG. 5 is skipped, that is, steps 222 to 228 are skipped. In this situation, actual phase PA can quickly reach at the target phase PT, so that response of the phase control can be enhanced.

When hydraulic pressure PH is greater than the predetermined pressure β, the stopper piston 32 can be sufficiently forced by hydraulic pressure so that the stopper piston 32 can be quickly pulled out of the engaging hole 37. Therefore, in this situation, the main portion of the second phase control routine shown in FIG. 5 need not to be executed.

Other Embodiment

The main portions of the first and second phase control routines shown in FIGS. 4, 5, i.e., steps 202 to 210, and steps 222 to 228 can be executed regardless of hydraulic pressure PH.

One of the first and second hydraulic chambers 40, 42, which communicates with either the retarding hydraulic chambers 51, 52, 53, 54 or the advancing hydraulic chambers 55, 56, 57, 58, can be used as the releasing chamber. In this structure, when the stopper piston 32 engages with the engaging hole 37 at the most retarding position as the starting phase PS, the hydraulic chamber, which communicates with the advancing hydraulic chamber, is preferably determined to be the releasing chamber. When the stopper piston 32 engages with the engaging hole 37 at the most advancing position as the starting phase PS, the hydraulic chamber, which communicates with the retarding hydraulic chamber, is preferably determined to be the releasing chamber.

Determination of hydraulic pressure PH performed at steps 200, 220 are omitted in the first and second phase control routine shown in FIGS. 4 and 5, when one of the first and second hydraulic chambers 40, 42, which communicates with either of the retarding hydraulic chambers 51, 52, 53, 54 or the advancing hydraulic chambers 55, 56, 57, 58, is used as the releasing chamber.

The phase control routines can be applied to a valve timing control apparatus, in which valve timing of only an intake valve 171 is controlled or valve timings of both an intake valve 171 and an exhaust valve 172 are controlled. In this case, the starting phase PS, in which the stopper piston 32 engages with the engaging hole 37 at the predetermined angular position, may correspond to one of the most retarding angular position, the most advancing angular position, and an intermediate position between the most retarding angular position and the most advancing angular position.

The stopper piston 32 may be radially moved to an engaging ring, instead of the above structure, in which the stopper piston 32 axially moves to the engaging ring 36.

The stopper piston 32 may be received in a driver-side rotating member, and the engaging hole 37 can be formed in a driven-side rotating member.

Driving force of the crankshaft 150A can be transmitted to the camshaft 1 using a power train such as a timing pulley, a timing gear, instead of the chain sprocket 11.

Driving force of the crankshaft 150A, i.e., driveshaft can be transmitted to the vane rotor 16, so that the camshaft 1 i.e., driven shaft and the shoe housing 12, can be integrally rotated.

Various modifications and alternations may be diversely made to the above embodiments without departing from the spirit of the present invention.

What is claimed is:

1. A valve timing control apparatus that is provided to a power train system, which transmits driving force from a driveshaft of an internal combustion engine to a driven shaft that opens and closes at least one of an intake valve and an exhaust valve, the valve timing control apparatus controlling at least one of open-close timing of the intake valve and open-close timing of the exhaust valve, the valve timing control apparatus comprising:

a driver-side rotating member that rotates in conjunction with the driveshaft of the internal combustion engine;

a driven-side rotating member that rotates in conjunction with the driven shaft, wherein one of the driver-side rotating member and the driven-side rotating member defines a chamber;

a vane that is provided to the other of the driver-side rotating member and the driven-side rotating member, the vane received in the chamber such that the vane partitions the chamber into a retarding chamber and an advancing chamber, in which fluid pressure is applied to the driven-side rotating member so that the driven-side rotating member is rotated to a retarding angular side and an advancing angular side with respect to the driver-side rotating member, wherein one of the driver-side rotating member and the driven-side rotating member defines an engaging hole;

an engaging member that is received in the other of the driver-side rotating member and the driven-side rotating member, wherein the engaging member engages with the engaging hole to restrict the driven-side rotating member from rotating with respect to the driver-side rotating member when the driven-side rotating member is at a predetermined angular position with respect to the driver-side rotating member;

a restrictively biasing means that biases the engaging member in a direction in which the engaging member engages with the engaging hole;

a restricting means that has at least one of a first hydraulic chamber, which communicates with the retarding chamber, and a second hydraulic chamber, which communicates with the advancing chamber, to define a releasing chamber in which fluid pressure is applied to the engaging member in a direction in which engagement between the engaging member and the engaging hole is released;

a switching valve that includes a solenoid actuator and a valve member, wherein the valve member is displaced by driving force generated by the solenoid actuator to switch following two operations, in which working fluid is supplied to all of the retarding chamber, the advancing chamber and the releasing chamber, and working fluid is drained from all of the retarding chamber, the advancing chamber and the releasing chamber; and a control means that controls current supplied to the solenoid actuator, wherein the control means duty-controls current supplied to the solenoid actuator to control the phase of the driven-side rotating member with respect to the driver-side rotating member such that working fluid is supplied to all of the retarding chamber, the advancing chamber and the releasing chamber, when the driven-side rotating member approaches the predetermined angular position, which corresponds to a target phase with respect to the driver-side rotating member.

2. The valve timing control apparatus according to claim 1, wherein the control means duty-controls current supplied to the solenoid actuator, and when phase of the driven-side rotating member with respect to the driver-side rotating member substantially coincides with the target phase, which is the predetermined angular position, working fluid is drained from one of the retarding chamber and the advancing chamber, so that force applied from the releasing chamber to the engaging member in a direction, in which the engaging member is pulled out of the engaging hole, decreases.

3. The valve timing control apparatus according to claim 1, wherein the releasing chamber includes both the first hydraulic chamber and the second hydraulic chamber, and when fluid pressure is less than a predetermined pressure, the control means controls the phase of the driven-side rotating member with respect to the driver-side rotating member.

4. A valve timing control apparatus that is provided to a power train system, which transmits driving force from a driveshaft of an internal combustion engine to a driven shaft that opens and closes at least one of an intake valve and an exhaust valve, the valve timing control apparatus controlling at least one of open-close timing of the intake valve and open-close timing of the exhaust valve, the valve timing control apparatus comprising:

a driver-side rotating member that rotates in conjunction with the driveshaft of the internal combustion engine;

a driven-side rotating member that rotates in conjunction with the driven shaft, wherein one of the driver-side rotating member and the driven-side rotating member defines a chamber;

a vane that is provided to the other of the driver-side rotating member and the driven-side rotating member, the vane received in the chamber such that the vane partitions the chamber into a retarding chamber and an advancing chamber, in which fluid pressure is applied to the driven-side rotating member so that the driven-side rotating member is rotated to a retarding angular side and an advancing angular side with respect to the driver-side rotating member, wherein one of the driver-side rotating member and the driven-side rotating member defines an engaging hole;

an engaging member that is received in the other of the driver-side rotating member and the driven-side rotating member, wherein the engaging member engages with the engaging hole to restrict the driven-side rotating member from rotating with respect to the driver-side rotating member when the driven-side rotating member is at a predetermined angular position with respect to the driver-side rotating member;

a restrictively biasing means that biases the engaging member in a direction in which the engaging member engages with the engaging hole;

a restricting means that has at least one of a first hydraulic chamber, which communicates with the retarding chamber, and a second hydraulic chamber, which communicates with the advancing chamber, to define a releasing chamber in which fluid pressure is applied to the engaging member in a direction in which engagement between the engaging member and the engaging hole is released;

a switching valve that includes a solenoid actuator and a valve member, wherein the valve member is displaced by driving force generated by the solenoid actuator to switch following two operations, in which working fluid is supplied to all of the retarding chamber, the advancing chamber and the releasing chamber, and working fluid is drained from all of the retarding chamber, the advancing chamber and the releasing chamber; and a control means that controls current supplied to the solenoid actuator, wherein the control means duty-controls current supplied to the solenoid actuator to control the phase of the driven-side rotating member with respect to the driver-side rotating member, and when the driven-side rotating member rotates from the predetermined angular position to a target phase with respect to the driver-side rotating member, working fluid is supplied to all of the retarding chamber, the advancing chamber and the releasing chamber, subsequently, working fluid is drained from one of the retarding chamber and the advancing chamber, simultaneously with supplying working fluid into the other of the retarding chamber and the advancing chamber to rotate the driven-side rotating member to the target phase with respect to the driver-side rotating member.

5. The valve timing control apparatus according to claim 4, wherein the control means duty-controls current supplied to the solenoid actuator, and when phase of the driven-side rotating member with respect to the driver-side rotating member substantially coincides with the target phase, which is the predetermined angular position, working fluid is drained from one of the retarding chamber and the advancing chamber, so that force applied from the releasing chamber to the engaging member in a direction, in which the engaging member is pulled out of the engaging hole, decreases.

6. The valve timing control apparatus according to claim 4, wherein the releasing chamber includes both the first hydraulic chamber and the second hydraulic chamber, and when fluid pressure is less than a predetermined pressure, the control means controls the phase of the driven-side rotating member with respect to the driver-side rotating member.

7. A valve timing control apparatus that is provided to a power train system, which transmits driving force from a driveshaft of an internal combustion engine to a driven shaft that opens and closes at least one of an intake valve and an exhaust valve, the valve timing control apparatus controlling at least one of open-close timing of the intake valve and open-close timing of the exhaust valve, the valve timing control apparatus comprising:

a driver-side rotating member that rotates in conjunction with the driveshaft of the internal combustion engine;

a driven-side rotating member that rotates in conjunction with the driven shaft, wherein one of the driver-side rotating member and the driven-side rotating member defines a chamber;

a vane that is provided to the other of the driver-side rotating member and the driven-side rotating member, the vane received in the chamber such that the vane partitions the chamber into a retarding chamber and an advancing chamber, in which fluid pressure is applied to the driven-side rotating member so that the driven-side rotating member is rotated to a retarding angular side and an advancing angular side with respect to the driver-side rotating member, wherein one of the driver-side rotating member and the driven-side rotating member defines an engaging hole;

an engaging member that is received in the other of the driver-side rotating member and the driven-side rotating member, wherein the engaging member engages with the engaging hole to restrict the driven-side rotating member from rotating with respect to the driver-side rotating member when the driven-side rotating member is at a predetermined angular position with respect to the driver-side rotating member;

a restrictively biasing means that biases the engaging member in a direction in which the engaging member engages with the engaging hole;

a restricting means that has at least one of a first hydraulic chamber, which communicates with the retarding chamber, and a second hydraulic chamber, which communicates with the advancing chamber, to define a releasing chamber in which fluid pressure is applied to the engaging member in a direction in which engagement between the engaging member and the engaging hole is released;

a switching valve that includes a solenoid actuator and a valve member, wherein the valve member is displaced by driving force generated by the solenoid actuator to switch following two operations, in which working fluid is supplied to all of the retarding chamber, the advancing chamber and the releasing chamber, and working fluid is drained from all of the retarding chamber, the advancing chamber and the releasing chamber; and a control means that controls current supplied to the solenoid actuator, wherein the control means duty-controls current supplied to the solenoid actuator to control the phase of the driven-side rotating member with respect to the driver-side rotating member, when the driven-side rotating member approaches a first target phase, which is the predetermined angular position with respect to the driver-side rotating member, working fluid is supplied to all of the retarding chamber, the advancing chamber and the releasing chamber, and when the driven-side rotating member rotates from the predetermined angular position to a second target phase with respect to the driver-side rotating member, working fluid is supplied to all of the retarding chamber, the advancing chamber and the releasing chamber, subsequently working fluid is drained from one of the retarding chamber and the advancing chamber, simultaneously with supplying working fluid into the other of the retarding chamber and the advancing chamber to rotate the driven-side rotating member to the second target phase with respect to the driver-side rotating member.

8. The valve timing control apparatus according to claim 7, wherein the control means duty-controls current supplied to the solenoid actuator, and when phase of the driven-side rotating member with respect to the driver-side rotating member substantially coincides with the target phase, which is the predetermined angular position, working fluid is drained from one of the retarding chamber and the advancing chamber, so that force applied from the releasing chamber to the engaging member in a direction, in which the engaging member is pulled out of the engaging hole, decreases.

9. The valve timing control apparatus according to claim 7, wherein the releasing chamber includes both the first hydraulic chamber and the second hydraulic chamber, and when fluid pressure is less than a predetermined pressure, the control means controls the phase of the driven-side rotating member with respect to the driver-side rotating member.

* * * * *